US006155852A

United States Patent [19]

Ozawa et al.

[11] Patent Number: 6,155,852

[45] Date of Patent: Dec. 5, 2000

[54] ELECTRIC CONNECTOR FOR CARD

[75] Inventors: Hiroshi Ozawa; Mitsuo Nakamura; Nobuhito Ebine, all of Tokyo; Masaki Hanzawa, Chiba, all of Japan

[73] Assignees: Hirose Electric Co., Ltd.; Sony Corporation, both of Tokyo, Japan

[21] Appl. No.: 09/420,841

[22] Filed: Oct. 19, 1999

[30] Foreign Application Priority Data

Oct. 19, 1998 [JP] Japan ..... 10-296470

[51] Int. Cl.[7] ..... H01R 13/62

[52] U.S. Cl. ..... 439/159

[58] Field of Search ..... 439/159, 382, 439/384, 327, 152–157, 160; 361/754, 798

[56] References Cited

U.S. PATENT DOCUMENTS 5,197,894 3/1993 Koike ..... 439/159
5,655,918 8/1997 Soh ..... 439/159
5,967,810 10/1999 Spicker et al. ..... 439/159
6,022,228 2/2000 Kuo ..... 439/159
6,033,243 3/2000 Kajiura ..... 439/159
6,042,404 3/2000 Lai et al. ..... 439/159
6,045,377 4/2000 Kajiura ..... 439/159

*Primary Examiner*—Gary F. Paumen
*Assistant Examiner*—Phuongchi Nguyen
*Attorney, Agent, or Firm*—Kanesaka & Takeuchi

[57] ABSTRACT

An eject lever 8 has a pressing piece 14 which is bent so as to be in parallel with the card surface; the plate thickness surface of the pressing piece forms a pressing surface to be contacted with the eject lever; the plate thickness surface of a part of the eject lever 12 provides a pressed piece 16 having a pressed surface which can be contacted with the pressing surface; and by the pressed surface, the pressing force from the pressing surface is received as a force to turn the eject lever.

5 Claims, 6 Drawing Sheets

ELECTRIC CONNECTOR FOR CARD

BACKGROUND OF THE INVENTION

1. Field of the Invention

The present invention relates to an electric connector for card.

2. Description of the Prior Art

A card incorporating a storage medium, such as a PC card, is inserted into a slot formed in the housing of an electronic device to be connected with a connector inside thereof for use, and after use, it can be drawn out with a disconnection mechanism. This disconnection mechanism generally comprises an eject bar, an eject lever, and a plate. The eject bar extends along the direction of insertion of the card in parallel with the side end surface of the card, and the rear end of it is provided with an operation pushbutton, being located outside of the housing, while the front end of it is engaged with the eject lever. The eject lever, which is made of a plate material, is located in parallel with and close to the card surface perpendicular to the side end surface, and can be freely turned in the plate plane as a lever. One end of this eject lever is engaged with the eject bar, and by the pressing pressure from the eject bar, the eject lever is turned. The direction of this turning force is inverted at the point of application formed in the portion opposite to the turning fulcrum, resulting in a plate which can be moved in the direction of insertion and drawing-out of the card being pressed. The plate has a hook portion which is engaged with the front end of the card in the direction of insertion, pressing the card in the direction of drawing-out with the hook portion to disconnect the card from the connector for allowing it to be drawn out.

For electronic devices using a card, such as a personal computer, reduction in size is a constant demand. However, if the above-stated disconnection mechanism is adopted, it is difficult to reduce the size of a device along the direction of the width of the card. The reason for this is in the portion where the eject bar is engaged with the eject lever. Generally, as shown in FIG. 6, one end of an eject lever 51 is protruded to the outside of an eject bar 52 along the direction of the width of the card, where it is bent, and the bent portion 53 is inserted into an engaging groove 54 in the eject bar 52 for engagement. And, the eject bar 52 must press the eject lever 51 by the bent portion 53, and accommodate the turning movement of the bent portion given by the turning of the eject lever 51. Therefore, the engaging portion is greatly protruded from the side surface of the eject bar 52 along the direction of the width. For only this engagement portion, the dimension along the direction of the width of the disconnecting mechanism, i.e., the electronic device is increased.

With the electric connector for card according to the present invention, a card is inserted into a slot formed in the housing to be connected with a connector inside thereof, and the card is drawn out from the connector with a disconnection mechanism. The disconnection mechanism has an eject bar and an eject lever. The eject bar is disposed in parallel with the side end surface of the card extending along the direction of insertion and drawing-out of the card, being provided in the form of a long plate which can be moved along the direction of insertion and drawing-out. And, the eject lever is disposed roughly in parallel with the card surface perpendicular to the side end surface, comprising a plate which can be turned as a lever. The eject lever is engaged with the eject bar at one end to receive a turning force, and at the other end or in the middle portion, transmit the turning force to the card directly or indirectly as a card drawing-out force.

With such an electric connector of the present invention, the eject bar has a pressing piece bent so as to be in parallel with the card surface, and the plate thickness surface of the pressing piece forms a pressing surface to be contacted with the eject lever. On the other hand, the plate thickness surface of a portion of the eject lever forms a pressed surface which can be contacted with the pressing surface, so that the pressed surface can receive a pressing force from the pressing surface as a force to turn the eject lever.

With the present invention providing such a configuration, one end of the eject lever will not protrude to the outside of the position of the eject bar.

The pressing piece of the eject bar for engagement of the eject bar with the eject lever is bent toward the card surface, the plate thickness surface of the pressing piece forming a pressing surface, and the pressing surface being contacted with the plate thickness surface of a part of the eject lever. In other words, the space required for the eject bar to be contacted or engaged with the eject lever is within the plate thickness of the pressing piece or a dimension close to it. This pressing piece, i.e., the eject bar has a small plate thickness, and with conventional electric connectors for card, such a space has been left unused amply around the mechanism for turning the eject lever, thus, with the present invention, the engagement portion can be contained in this space. This means that no additional space is required. Thus, with the present invention, the disconnecting mechanism can be made more compact along the direction of the width with no need for increasing the dimension along the direction of the thickness of the card.

With the present invention, the disconnecting mechanism has a positional restriction section which allows the eject bar and the eject lever restrict each other in the direction perpendicular to the card surface, and it is preferable that the positional restriction section is comprised of a restricting piece parallel with the card surface which is provided for at least one of the eject bar and the eject lever, and a surface of at least one of the eject bar and the eject lever which is subject to restriction in the direction perpendicular to the card surface by the restricting piece.

Because the pressing surface of the eject bar and the pressed surface of the eject lever are approximately within the range of the plate thickness of the pressing piece, thus, the relative positions of them may be varied, however, by providing the above-stated positional restriction section, occurrence of variation in the relative position can be prevented, thus, the pressing surface and the pressed surface can always maintain their normal relative positions.

The disconnecting mechanism can also be formed so that it has a plate which can be moved along the direction of insertion and drawing-out of the card, and the card drawing-out force from the eject lever can be transmitted to the card through the plate.

Further, the eject bar can be provided with a pressing piece in two places along the direction of insertion and drawing-out of the card, and the eject lever can have a pressed piece which can be contacted with the two pressing piece. By doing this, the eject bar and the eject lever can be engaged with each other in the direction of insertion and drawing-out of the card, i.e., both directions.

With an electric connector having an eject bar and an eject lever according to the present invention, to perform engagement of both with each other, a space left in the vicinity of the surface of the flat plate-like eject lever which is in parallel with the card surface is utilized for contacting the plate thickness surfaces (the end surfaces) of both with each other, therefore, the need for an additional space has been eliminated, and the device size has been reduced by the amount corresponding to the space around the side of the eject bar which has been required of conventional electric connectors for card for the engagement. If the space required along the direction of the plate thickness should exceed the space left in the vicinity of the surface of the eject lever, the amount of excess is extremely small, because the engagement is performed within the range of the plate thickness, thus, the effects of the reduction in device size is not deteriorated.

SUMMARY OF THE INVENTION

The present invention is intended to offer an electric connector for card which has a disconnection mechanism to allow reduction in size along the direction of the width.

| | |
|---|---|
| 2 | Connector |
| 8 | Eject bar |
| 11 | Plate |
| 12 | Eject lever |
| 14 | Pressing piece |
| 15 | Restricting piece |
| 16 | Pressed piece |
| 17 | Restricting piece |
| C | Card |

DESCRIPTION OF THE PREFERRED EMBODIMENTS

The preferred embodiments of an electric connector for card of the present invention will be described hereinbelow with reference to the attached drawings.

Figure 1:
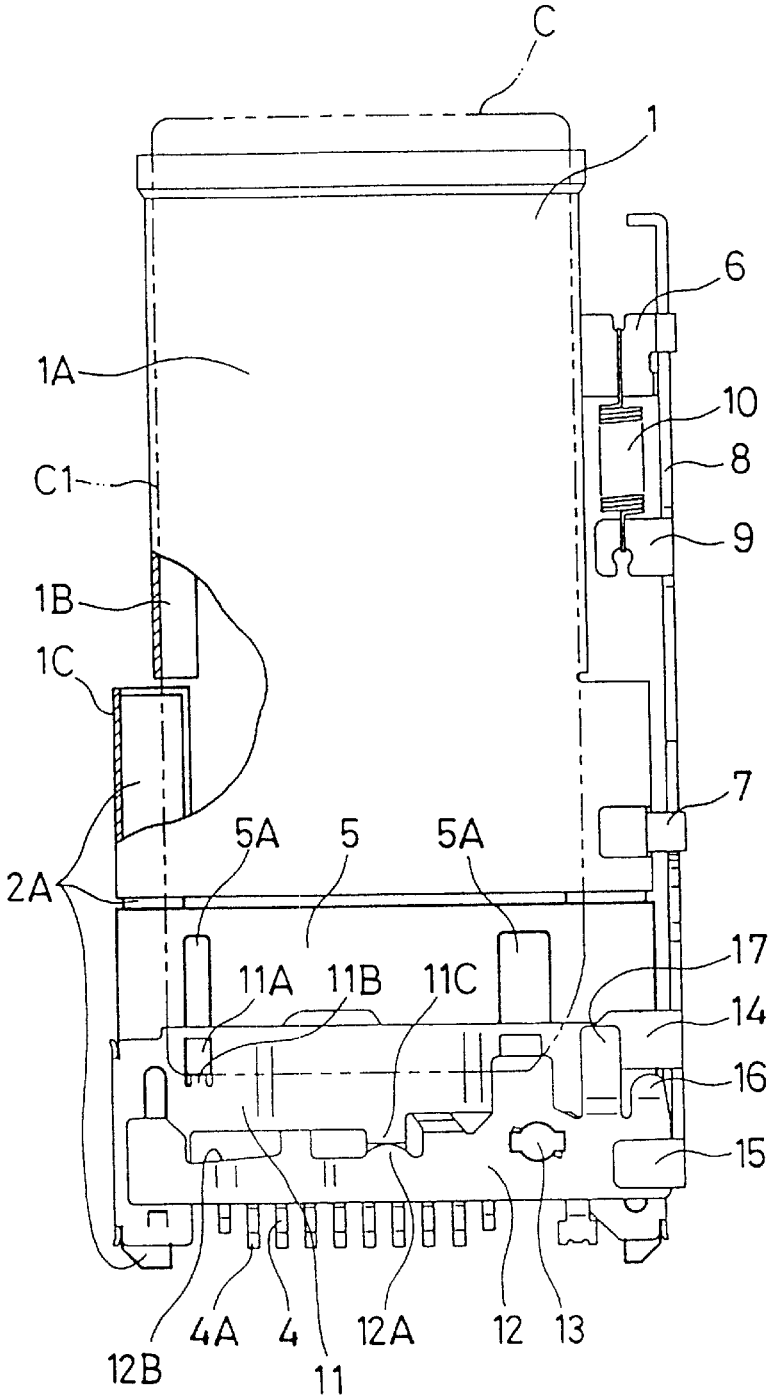
FIG. 1A and FIG. 1B illustrate a device of an embodiment of the present invention, FIG. 1A showing a plan view of it when a card is inserted into it, and FIG. 1B a side view of it.
Figure 1B:
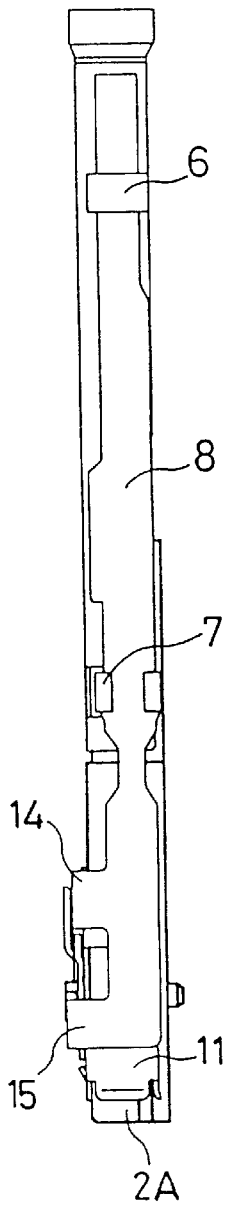
Figure 2:
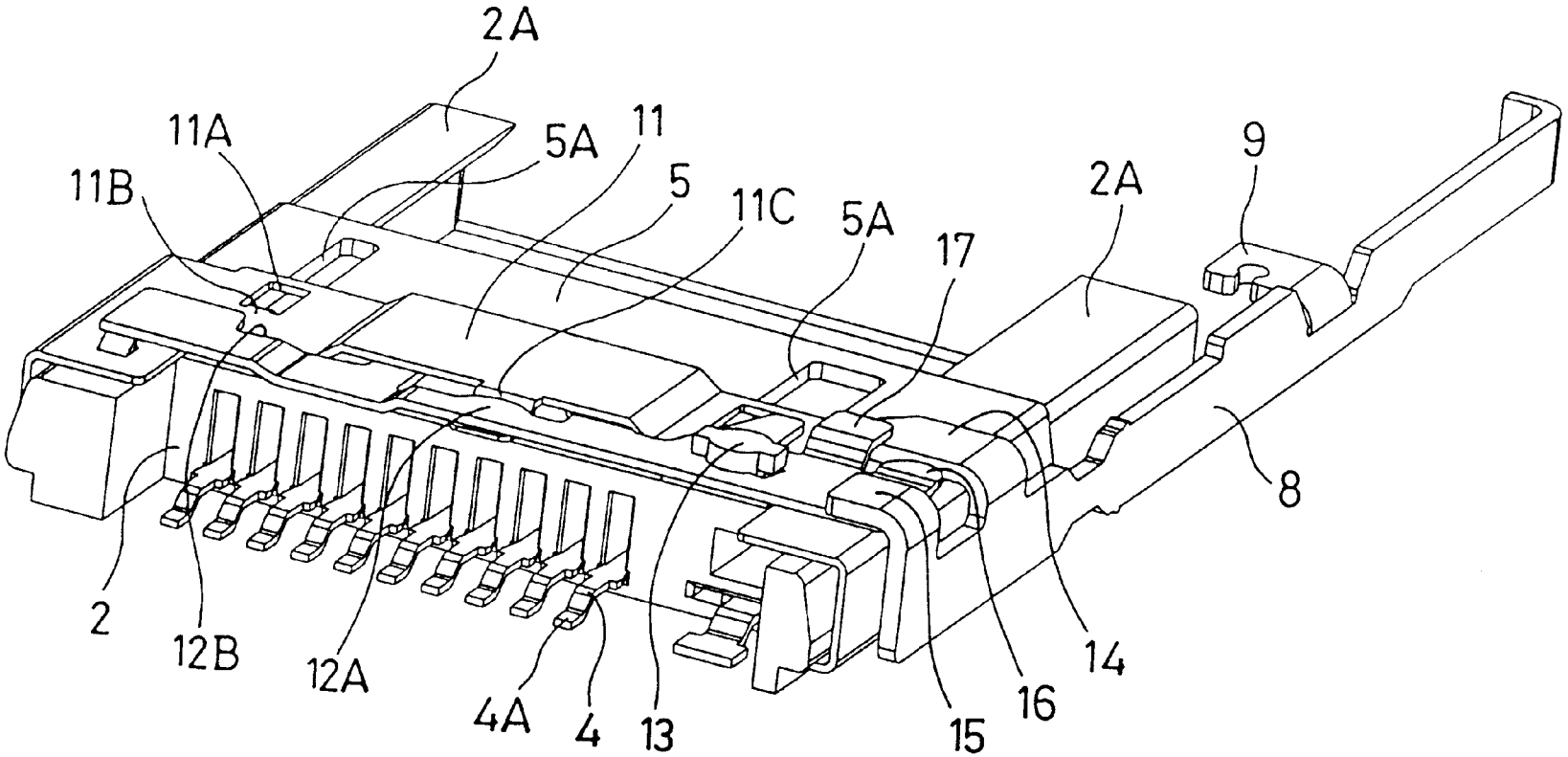
FIG. 2 shows a fragmentary perspective view of the device as shown in FIG. 1A and FIG. 1B.

FIG. 1A to FIG. 3 illustrate a device of a first embodiment of the present invention, FIG. 1A showing a plan view of it when a card is inserted into it; FIG. 1B a side view of it; FIG. 2 a fragmentary perspective view of the device as shown in FIG. 1A and FIG. 1B; and FIG. 3 a plan view of the device as shown in FIG. 1A and FIG. 1B when the card is being drawn out from it.

In FIG. 1A, reference number 1 denotes a holder, which is mounted, being fixed within a slot in the housing of an electronic device (not shown). The holder 1, which is manufactured by blanking a metallic sheet, and bending a blank obtained, has a flat top plate portion 1A, which is in parallel with the paper surface in FIG. 1A; and a guide supporting portion 1B and a holding portion 1C, which are provided on both sides, extending longitudinally (vertically in FIG. 1A), being opposed to each other. The guide supporting portion 1B is formed in the U shape by bending it from a side edge C1 of the top plate portion 1A in the direction perpendicular to the top plate portion 1A (in the direction to the back of the paper surface in FIG. 1A) so that a card C for such a device as a personal computer can be movably guided and supported by the side portions of the card C in the direction of insertion and drawing-out of the card C (hereafter the words "forward" and "backward" are used in place of the phrases "in the direction of insertion" and "in the direction of drawing-out", respectively). The holding portion 1C provided in front of the guide supporting portion 1B is also formed in the U shape as with the guide supporting portion 1B, and therein, one of a pair of arms 2A extending backward from both sides of the housing of a connector 2 is fitted to be held. In the housing of the connector 2, a plurality of contactors 4 are mounted, and each of the contactors 4 has a connection portion 4A protruding forward from the housing and a contact portion (not shown) connecting to the card C in the rear portion of the housing. Between the pair of arms 2A is provided a guide plate 5. Thus, in front of the holder 1 is provided a guide surface which is in parallel with the holder 1.

To one of the side edges of the holder 1, two guide pieces 6 and 7 are mounted as if they project sideward, holding an eject bar 8 so that it can be moved forward and backward, being guided and supported by them.

The eject bar 8, which is made of a relatively thick metallic plate, is formed in the shape of a lengthwise long rod, the surface being in parallel with the side end surface of the card C, in other words, the side surfaces of the guide supporting portion 1B and the holding portion 1C, which are perpendicular to the paper surface in FIG. 1A. The eject bar 8 is provided with a projecting piece 9 in the middle portion, and between the projecting piece 9 and the guide piece 6, a tension spring 10 is provided. The tension spring 10 provides the eject bar 8 with a force to move backward. The eject bar 8 will be described later in detail.

On the guide plate 5 between the pair of arms 2A extending from the housing of the connector 2, a metallic plate 11 which is guided on the guide surface of the guide plate 5, being slid forward and backward, is movably provided. Both side edges of the plate 11 are bent as if they wind around the housing, so that the plate 11 can be slid on the guide surface of the guide plate 5 without being dislocated sideward. With the plate 11, a window portion 11A is formed in two places along the direction of the width, one edge of the window portion 11A providing a stopper 11B which is folded toward the back of the paper surface in FIG. 1A. The stopper 11B penetrates an oval hole 5A which is formed in the guide plate 5, being elongated crosswise, and is protruded from the bottom of the guide plate 5. Further, the plate 11 has a stepped stopper portion 11C which is protruded forward.

In the location closer to the eject bar 8 in the front portion of the guide plate 5, an eject lever 12 is mounted so that it can be turned around a pivot 13 as a lever. The eject lever 12 has a semi-circular pressing portion 12A and a pressing cutout 12B at the rear edge. The pressing portion 12A is positioned in contact with the engaging portion 11C of the plate 11 so that it can press the plate 11 backward. The eject lever 12 is slightly bent along the direction of the plate thickness in the portion of the pressing cutout 12B, so that, when the eject lever 12 is turned around the pivot 13 through a set angle, the edge of the pressing cutout 12B is brought into contact with the front edge of the plate 11 to press the plate 11 backward.

The above-described eject lever 8 has, in the front portion, a pressing piece 14 and a restricting piece 15 which are bent so as to be in parallel with the surface of the eject lever 12. The restricting piece 15 restricts the lifting of the eject lever 12, while allowing it to be turned, being placed close to the surface of the eject lever 12. On the other hand, the eject lever 12 has a pressed piece 16 and a restricting piece 17 which are protruded backward. The pressed piece 16 and the restricting piece 17 are slightly bent upward as if they are raised, being kept parallel with the surface of the body of the eject lever 12. In other words, the rear edge of the pressed piece 16 is within the range of the plate thickness of the pressing piece 14 of the eject bar 8 so that the edges can be positively contacted with each other by the respective plate thickness surfaces, and the restricting piece 17 is placed close to the pressing piece 14 to prevent the upward lifting of the pressing piece 14, while allowing relative movement of the pressing piece 14 of the eject bar 8 to it. Therefore, by the two restricting pieces 15 and 17, the relative position of the eject bar 8 to the eject lever 12 is maintained fixed in the direction perpendicular to the surface of the eject lever 12 with the displacement being prevented.

The electric connector for card of the above embodiment of the present invention is used in the following way for operation.

① When a card C is to be used, the card C is inserted into the slot of the housing of an electronic device, and pushed in. The front end of the card C pushes the plate 11 forward to the advanced position with the stopper 11B of the plate 11. The plate 11 pushes the pressing portion 12A of the eject lever 12 forward with the engaging portion 11C, resulting in the eject lever 12 being turned around the pivot 13 in a counterclockwise direction in FIG. 1A until the front edge is positioned approximately in parallel with the front edge of the connector. The card C pushed in is connected with the contact portion of the contactor 4 of the connector 2 at the front end.

Figure 3:
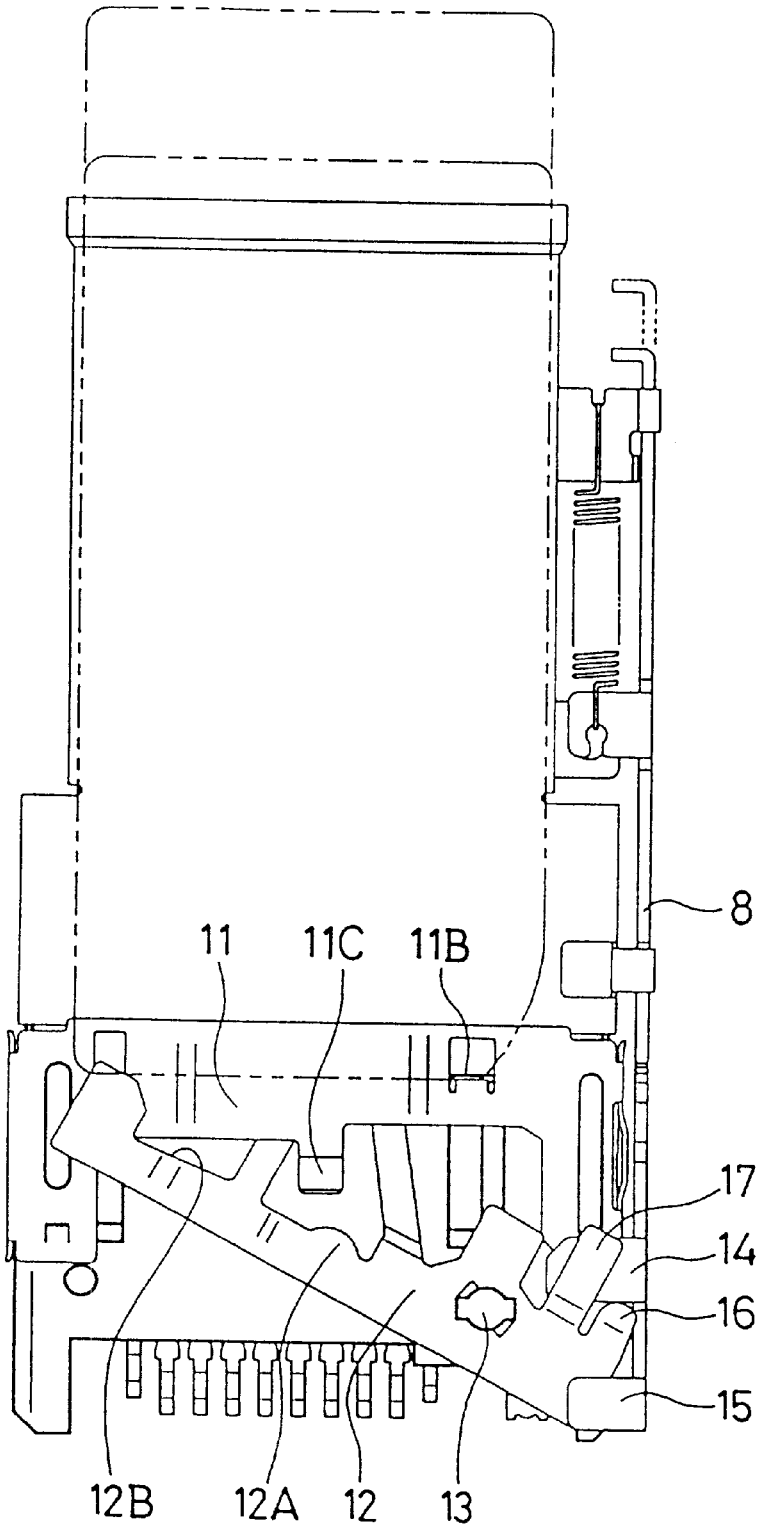
FIG. 3 shows a plan view of the device as shown in FIG. 1A and FIG. 1B when the card is being drawn out from it.

② Next, when the card C is to be drawn out for exchange or other purpose, the eject bar 8 is pushed forward by the rear end. In the example as illustrated, a pushbutton is not shown at the rear end, however, at the rear end of the eject bar 8, a pushbutton is mounted so that it is protruded outside of the surface of the electronic device, and this pushbutton is depressed as shown in FIG. 3.

③ The rod-like eject bar 8 is advanced, being guided and supported by the guide pieces 6 and 7, and the front end surface of the pressing piece 14 pushes the rear end surface of the pressed piece 16 of the eject lever 12 forward. As a result of this, the eject lever 12 is turned around the pivot 13 in a clockwise direction in FIG. 1A, the eject lever 12 retracting the plate 11, and the card C being pushed backward with the stopper 11B of the plate 11, and after being turned through a certain angle, with the edge of the pressing cutout 12B (see FIG. 3). Then, the card C is disconnected from the connector, being able to be drawn out. When the pressing force is transmitted from the pressing piece 14 of the eject bar 8 to the pressed piece 16 of the eject lever 12, the pressing piece 14 and the pressed piece 16 are not displaced along the direction of the plate thickness, resulting in their plate thickness surfaces (the ends) being positively contacted with each other, because the eject bar 8 and the eject lever 12 restrict the movement of each other along the direction of the plate thickness with the respective restricting pieces 15 and 17.

④ The eject bar 8 is energized backward with the spring 10, being retracted to be returned to the original position.

[0022]

Figure 4A:
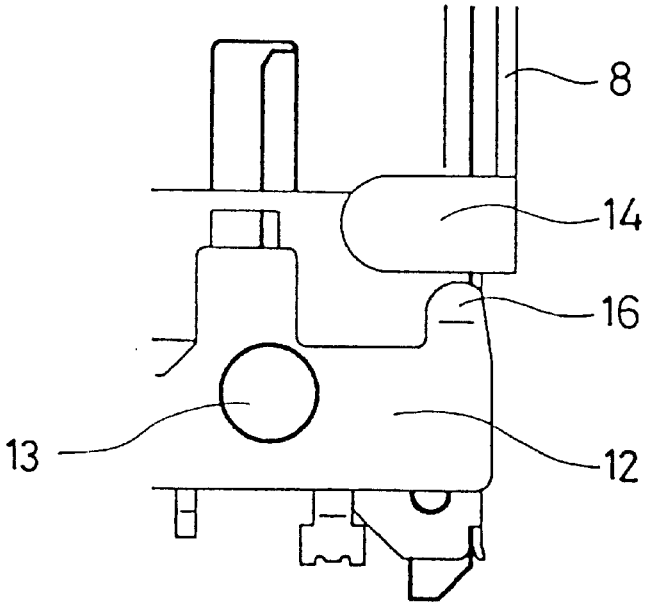
FIG. 4A illustrates a second embodiment of the present invention, showing a partial plan view of a device of it.
Figure 4B:
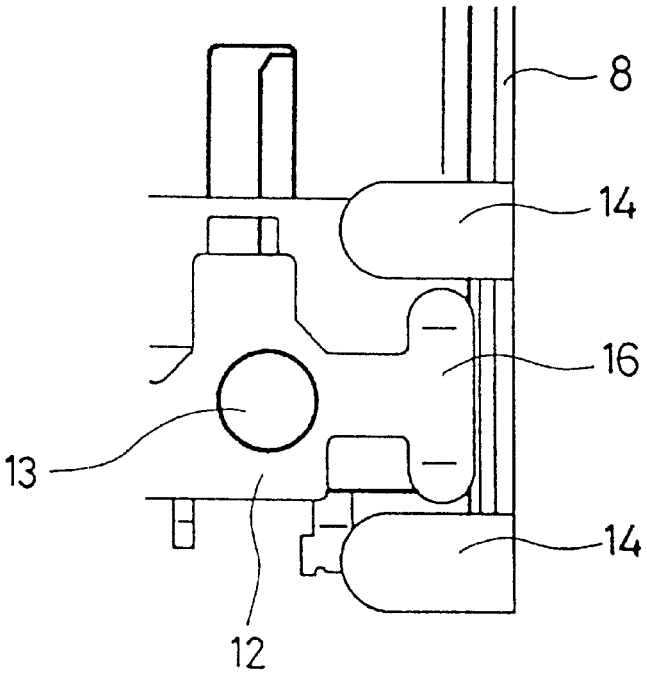
FIG. 4B illustrates a third embodiment of the present invention, showing a partial plan view of a device of it, which is a modification of the device as shown in FIG. 4A.

With the embodiment as illustrated in FIG. 1A and FIG. 1B, the eject bar 8 and the eject lever 12 restrict the displacement of each other along the direction of the plate thickness with the respective restricting pieces, however, if the plate thickness of one is sufficiently large as compared to that of the other, a slight manufacturing error, etc. can be positively covered, thus, the restricting pieces are not always required. With the embodiment as illustrated in FIG. 4A, a pressing piece 14 of an eject bar 8, for example, is provided with a plate thickness sufficiently larger than that of a pressed piece 16 of an eject lever 12. By doing this, if a relative displacement along the direction of the plate thickness is caused, the end surfaces are positively contacted with each other. Further, as shown in FIG. 4B, if an eject bar 8 is provided with two pressing pieces 14, and a pressed piece 16 of an eject lever 12 is contacted with both pressing pieces 14, the eject lever 12 is turned in both directions. The eject bar may be in parallel with the surface of the eject lever 12 rather than in parallel with the side end surface of the card C.

Figure 5A:
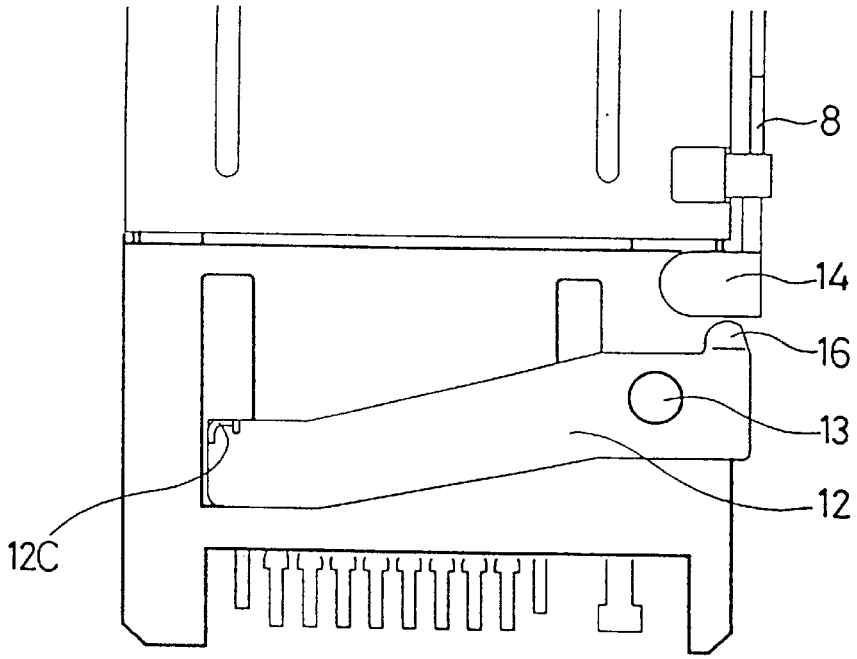
FIG. 5A and FIG. 5B show plan views of a device of a fourth embodiment of the present invention, FIG. 5A giving an illustration when a card is inserted into it, and FIG. 1B that when a card is drawn out from it.
Figure 5B:
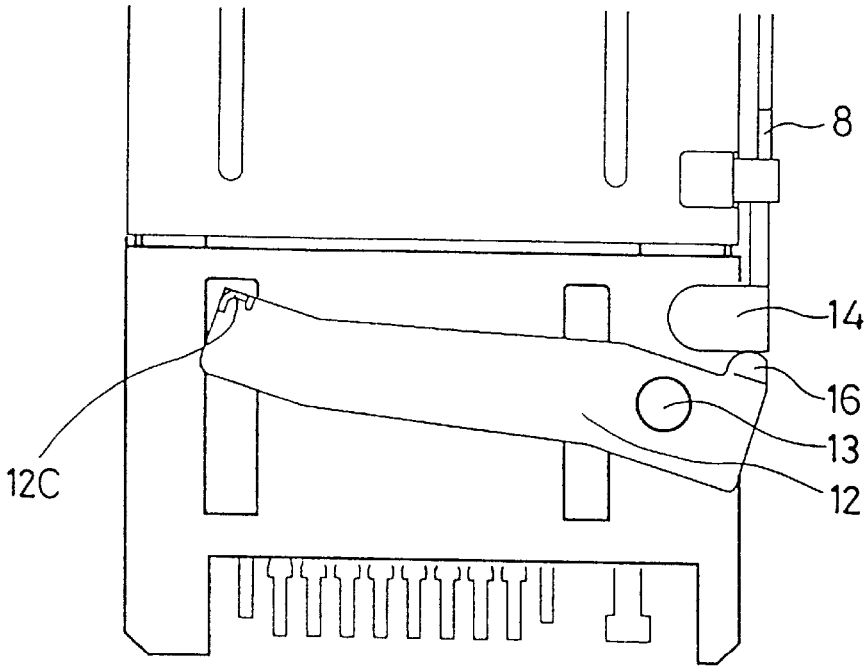
Figure 6:
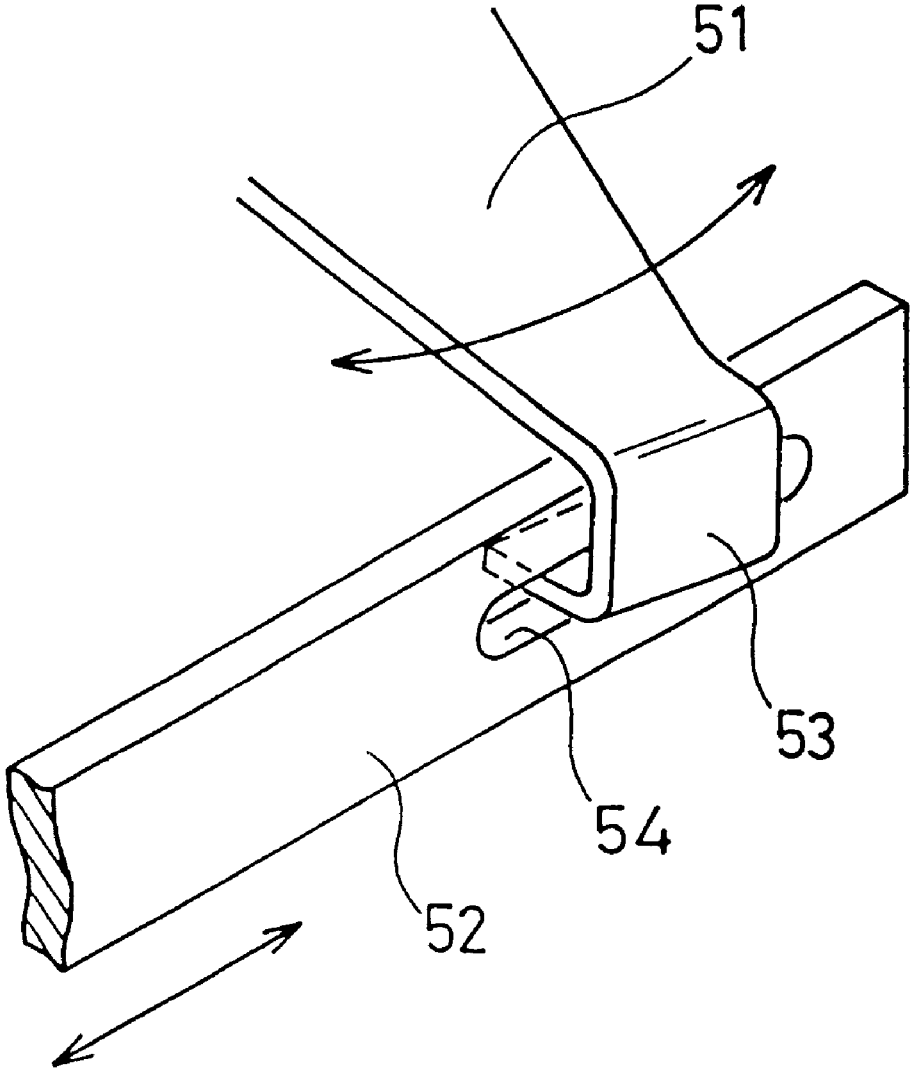
FIG. 6 shows a perspective view of the portion of a conventional device where an eject bar and an eject lever are engaged with each other.

Next, with the present invention, the plate 11 as shown in FIG. 1A and FIG. 1B is not essential. For example, as shown in FIG. 5A and FIG. 5B, if an eject lever 12 having a pressed piece 16 at one end is provided with a stopper 12C at the other end, the card can be directly pushed out with the stopper 12C when the eject lever 12 is turned by the force transmitted from a pressing piece 14 to a pressed piece 16 as shown in FIG. 5B, which reduces the number of parts required.

What is claimed is:

1. An electric connector for a card, comprising:

a housing having a slot for accommodating said card, a plurality of contactors provided in said housing and connected with said card, and an ejecting means for ejecting said card from said housing, said ejecting means comprising:

an eject bar in shape of a long plate movable in a direction of insertion and ejection of said card and having a pressing piece disposed in parallel with a surface of said card, and an eject lever disposed substantially in parallel with said card surface and having a pressed piece, said eject lever receiving a turning force at one end thereof when said eject lever engages with said eject bar and transmitting said turning force to said card at the other end or in the middle portion thereof to eject said card from said housing, wherein a surface of said pressing piece in a direction of thickness of a plate of said pressing piece contacts with a surface of said pressed piece in a direction of thickness of a plate of said pressed piece, thus providing said turning force.

2. An electric connector for a card according to claim 1, wherein at least one of said eject bar and eject lever has a restricting piece disposed in parallel with said card surface so that at least one surface of said eject bar and eject lever is restricted from movement in a direction perpendicular to said card surface by said restricting piece.

3. An electric connector for a card according to claim 1 or 2, wherein said ejecting means has a plate which is roved in said direction of insertion and ejection of said card, and said turning force from said eject lever is transmitted to said card through said plate to eject said card.

4. An electric connector for card according to claim 1 or 2, wherein said eject bar has two pressing pieces in said direction of insertion and ejection of said card such that said pressed piece of said eject lever is contacted with said two pressing pieces.

5. An electric connector for a card according to claim 4, wherein said eject bar has two pressing pieces in said direction of insertion and ejection of said card such that said pressed piece of said eject lever is contacted with said two pressing pieces.

* * * * *